US010794054B2

(12) United States Patent
Judd

(10) Patent No.: US 10,794,054 B2
(45) Date of Patent: Oct. 6, 2020

(54) PANELIZED WARP-CORNER FOR BUILDINGS

(71) Applicant: KNAPHUS EXTERIOR PANEL COMPANY, Salt Lake City, UT (US)

(72) Inventor: Steven G. Judd, West Valley City, UT (US)

(73) Assignee: KNAPHUS EXTERIOR PANEL COMPANY, Salt Lake City, UT (US)

( * ) Notice: Subject to any disclaimer, the term of this patent is extended or adjusted under 35 U.S.C. 154(b) by 0 days.

(21) Appl. No.: 16/575,881

(22) Filed: Sep. 19, 2019

(65) Prior Publication Data

US 2020/0056367 A1 Feb. 20, 2020

Related U.S. Application Data

(62) Division of application No. 15/973,008, filed on May 7, 2018, now Pat. No. 10,422,125.

(60) Provisional application No. 62/502,464, filed on May 5, 2017.

(51) Int. Cl.

| | |
|---|---|
| ***E04B 1/36*** | (2006.01) |
| ***E04B 1/61*** | (2006.01) |
| ***E04B 2/72*** | (2006.01) |
| ***E04B 2/90*** | (2006.01) |
| ***E04F 13/073*** | (2006.01) |
| *E04F 13/00* | (2006.01) |
| *E04F 13/08* | (2006.01) |

(52) U.S. Cl.

CPC ..... *E04B 1/36* (2013.01); *E04B 1/61* (2013.01); *E04B 2/721* (2013.01); *E04B 2/90* (2013.01); *E04F 13/0733* (2013.01); *E04B 2001/6195* (2013.01); *E04F 13/00* (2013.01); *E04F 13/0862* (2013.01); *E04F 2201/0594* (2013.01)

(58) Field of Classification Search

CPC ..... E04B 1/36; E04B 1/38; E04B 2/90; E04B 2/96; E04B 2/885

See application file for complete search history.

(56) References Cited

U.S. PATENT DOCUMENTS

| | | | | |
|---|---|---|---|---|
| 2,638,870 A | | 5/1953 | Macdonald | |
| 3,460,860 A | * | 8/1969 | Stevens, Jr. | E04D 1/365 160/231.2 |
| 3,545,407 A | | 12/1970 | Moore | |
| 4,338,990 A | * | 7/1982 | Blodee | A47B 47/03 160/229.1 |
| 4,640,061 A | * | 2/1987 | Trumley | E04B 1/34321 52/656.1 |
| 5,983,577 A | * | 11/1999 | Hays | E04B 1/24 52/640 |
| 6,434,908 B1 | * | 8/2002 | Ferrante | E04B 2/82 52/481.2 |
| 6,637,173 B1 | * | 10/2003 | Wheeler | E04B 2/7457 52/241 |

(Continued)

*Primary Examiner* — Babajide A Demuren
(74) *Attorney, Agent, or Firm* — Pate Baird, PLLC

(57) ABSTRACT

A corner construction with improved warping flexibility may feature two panels, or walls, hinged together to form a corner and then hinged to the underlying building structure or adjacent wall construction. Any flexible connection between the two panels in the central corner and the panels and underlying building structure or wall construction may be utilized, including hinges and flexible plate supports.

16 Claims, 10 Drawing Sheets

(56) References Cited

U.S. PATENT DOCUMENTS

| | | | | |
|---|---|---|---|---|
| 7,073,299 | B1 * | 7/2006 | diGirolamo | E04B 2/7453 403/103 |
| 7,159,365 | B2 * | 1/2007 | Cohen | E04B 2/7457 52/108 |
| 7,293,392 | B2 * | 11/2007 | Krumbacher | E04B 2/7457 403/103 |
| 8,453,403 | B2 * | 6/2013 | Wheeler | E04B 9/06 52/241 |
| 9,534,371 | B2 | 1/2017 | Judd | |
| 2006/0174572 | A1 * | 8/2006 | Tonyan | B32B 3/06 52/481.2 |
| 2006/0277841 | A1 * | 12/2006 | Majusiak | E04B 2/7457 52/105 |
| 2008/0216425 | A1 * | 9/2008 | Moscovitch | E04F 13/06 52/255 |
| 2013/0255178 | A1 | 10/2013 | Judd | |
| 2016/0057972 | A1 | 3/2016 | Sjolund | |

* cited by examiner

PANELIZED WARP-CORNER FOR BUILDINGS

RELATED APPLICATIONS

This application is a divisional of U.S. patent application Ser. No. 15/973,008, filed May 7, 2018, which claims the benefit of U.S. Provisional Patent Application Ser. No. 62/502,464, filed on May 5, 2017. Both the foregoing references are hereby incorporated herein by reference.

FIELD OF THE INVENTION

The present invention relates to the field of building construction and more particularly relates to a construction for a panelized exterior wall.

BACKGROUND OF THE INVENTION

Panelized exterior wall construction can reduce the time it takes to enclose a building and is most frequently accomplished by prefabricating, either on site, or remotely, large rectangular portions of the exterior walls (wall panels), which are then transported and lifted onto the structure and fastened to the supporting members. This kind of approach creates challenges at the building corners when horizontal building movement (story drift) occurs. The two adjoining walls move differentially from each other at the corner, one sliding and one tilting, and must have sufficient space (movement joint) to allow them to move independently, or localized, or perhaps, catastrophic, failure can occur. If localized failure occurs due to insufficient corner joints, the cladding material and possibly some of the wall framing can become dislodged and create a public safety hazard from falling debris. Building drifts of upwards of 2.5 inches or more are not uncommon, which, if sealed, generate 5 inch or larger joints. These large joints are often an architectural eyesore.

The present invention represents a departure from the prior art in that the panelized warp-corner of the present invention is a unique panel system that eliminates the need for a large joint at the corner of the building while accommodating large story drifts. Drifts up to 3 or 4 inches can be accommodated with joints in the range of 1 to 1.5", depending on the wall assembly. The corner element can be made of various sizes, but generally works best when the sides of the corners are in the range of four feet to eight feet wide.

SUMMARY OF THE INVENTION

In view of the foregoing disadvantages inherent in the known types of panelized exteriors, an improved corner panel construction. may provide a warp-capable panel construction that meets the following objectives: ease of assembly and installation while providing a stable but flexible construction with relatively small, dynamic joints. In order to accomplish these objectives, the warp-corner panel is designed to allow for some minor controlled distortions at the corner region and at the adjoining wall panels wherein one side of the corner, or the other, or both transform from a flat planar surface to a warped, hyperbolic-paraboloid, or double curved shape. The corner panel transfers loads to the adjacent wall panels across at least two connections at each vertical edge, generally situated at or near the top and bottom of the panel. At least one of the corner panel-to-adjacent wall panel connections, one each edge of the corner panel, are designed to transfer loads from the corner panel to the adjacent wall panel in the three principal orthogonal directions. The other connection on the same panel edge is designed to transfer loads from the corner panel to the adjacent wall panel in two or three of the principal orthogonal directions. Conceivably, the corner panels system could be supported along one side only, as long as adequate restraint for lateral forces were provided at the opposite panel edge. The corner panel-to-adjacent wall panel connections can be configured in several ways, including, but not limited to shearing type rotational hinges (like a door hinge), bearing type rotational hinges, or even a ball-in-socket type connection (like a trailer hitch).

The warp-corner panel can be configured with a single vertical corner member or a pair of vertical members slightly offset from the corner intersection. It can be configured with intermediate vertical, or horizontal, or perhaps even diagonal or inclined members, depending on the application.

Flexibility of the system is of prime importance and can be provided via a multitude of combinations of semi-flexible connections (for instance; plate bending, member bending, member torsion, or combinations thereof), and/or hinges. Obviously, stability is necessary but can also be provided via a multitude of solutions using the connection(s) within the panel and the connections to the supporting elements (adjacent wall or other structural elements) adjacent to the panel or the building itself.

In general, each vertical edge of the "L"-shaped corner panel system may have two or more connections to the supporting elements and the corner area of the corner panel may have a single member or two members to effectuate a connection of the other framing elements with the purpose of supporting the weight of the wall system, transmitting, or transferring in-plane and perpendicular loads, and providing the ability to flex. At least one vertical edge connections must have at least one connection to the supporting element (s) capable of supporting all or a portion of the weight of the panel. This is a marked difference from the inventor's prior invention, described in U.S. Pat. No. 9,534,371, where loads were supported in the wall studs and floors. The present invention is utilized where no such other load transmission is present. All connections to the supporting elements must be able to transfer induced and or applied loads in two horizontal orthogonal directions through semi-flexible connections or hinges to the supporting element. In the most common configuration each vertical edge of the "L"-shaped corner panel would have one gravity connection also capable of resisting in-plane and perpendicular to plane loads, in addition to one connection capable of resisting in-plane and perpendicular to plane loads; the corner framing would also need to transmit or transfer loads and forces in all three principal directions to adjacent supporting elements.

Another optional support configuration would be to make connections from the generally "L-shaped" corner panel from the horizontal members at or near the vertical edge of the panel to any adjacent supporting elements.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, a preferred embodiment of the panelized warp corner is herein described. It should be noted that the articles "a", "an", and "the", as used in this specification, include plural referents unless the content clearly dictates otherwise.

Figure 1:
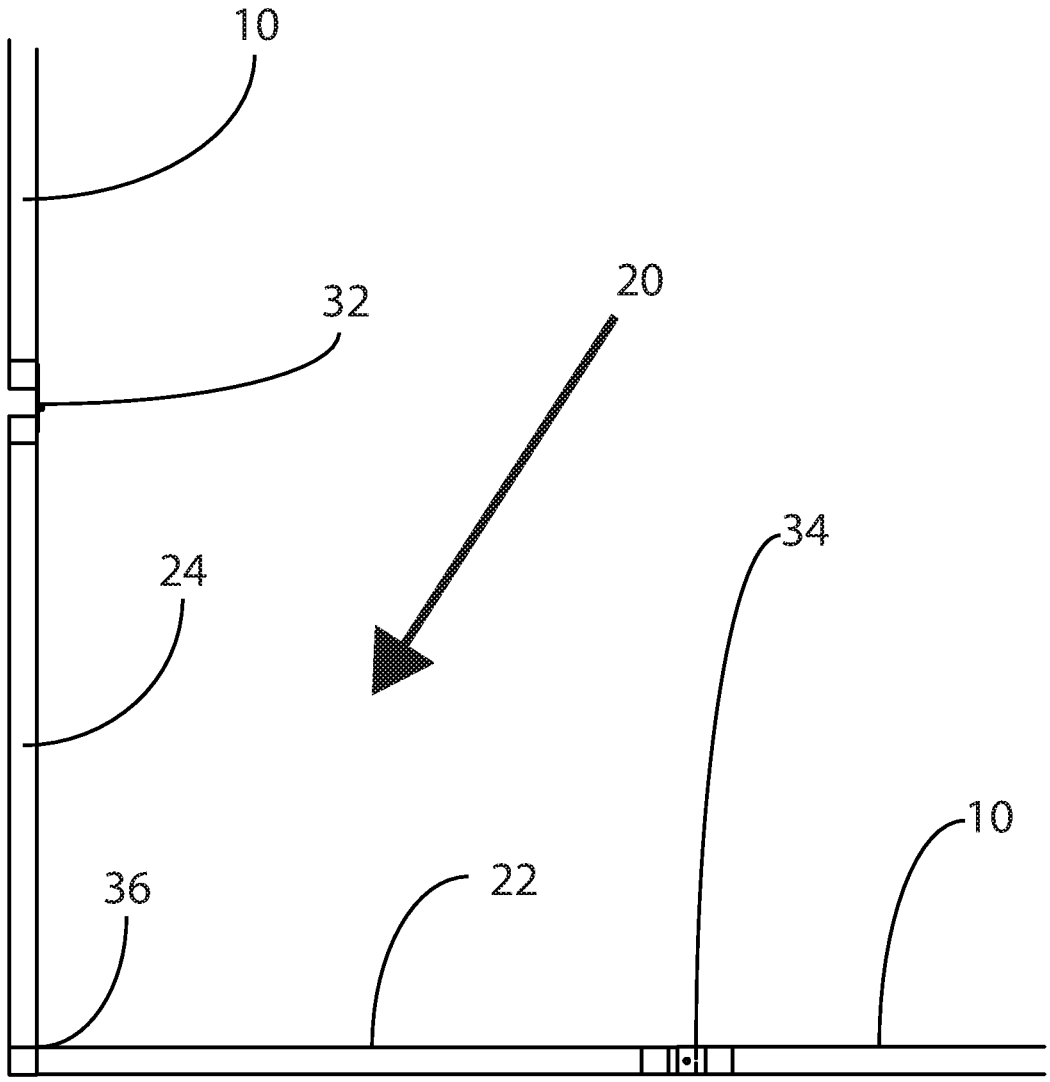
FIG. 1 is a top plan view of a corner constructed forming one embodiment of the invention.
Figure 3:
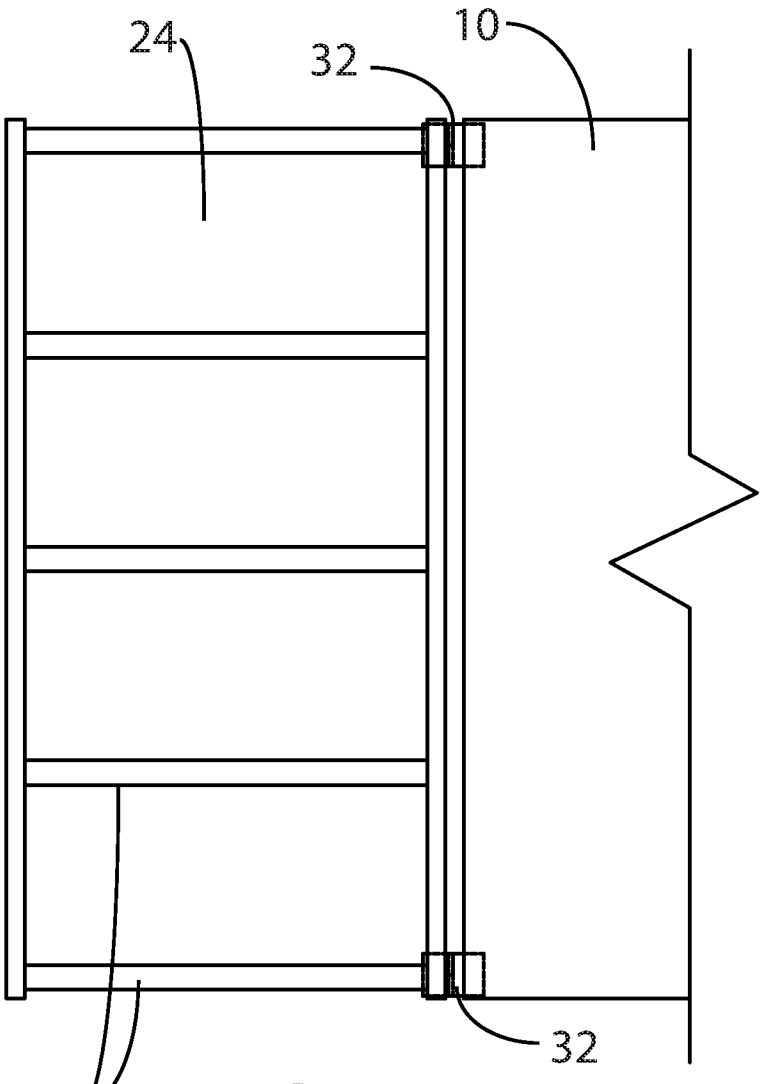
FIG. 3 is a left elevation of the corner of FIG. 1.
Figure 2:
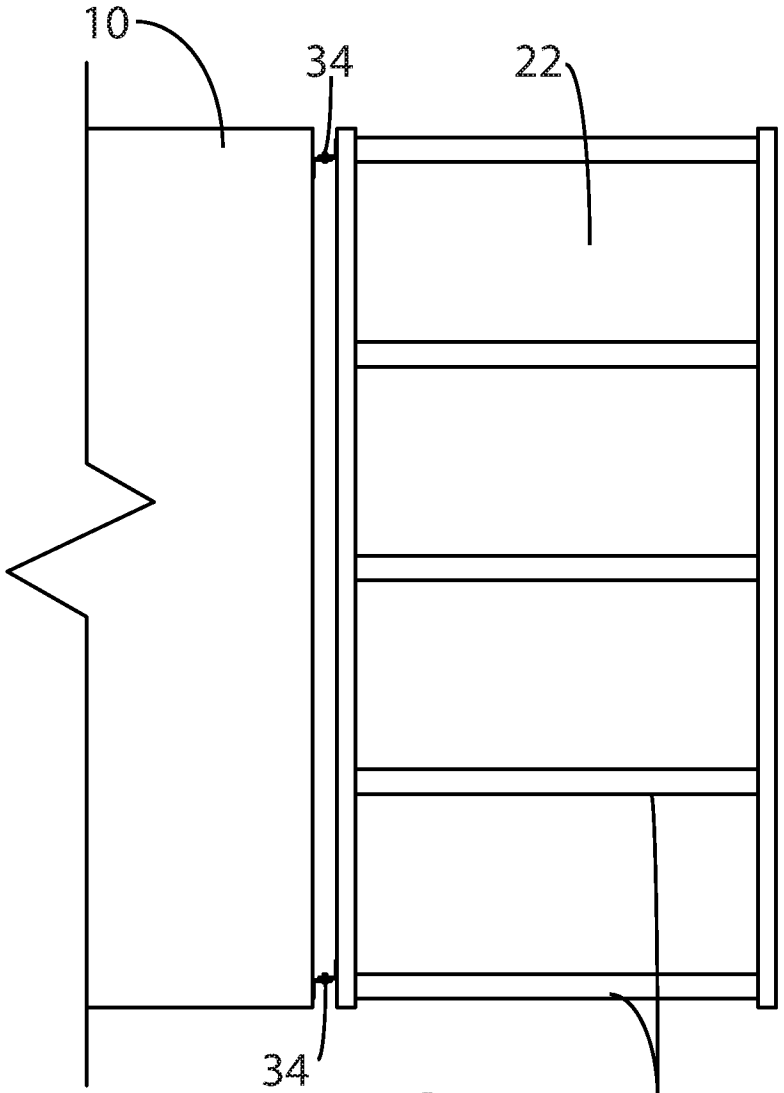
FIG. 2 is a right elevation of the corner of FIG. 1.
Figure 4:
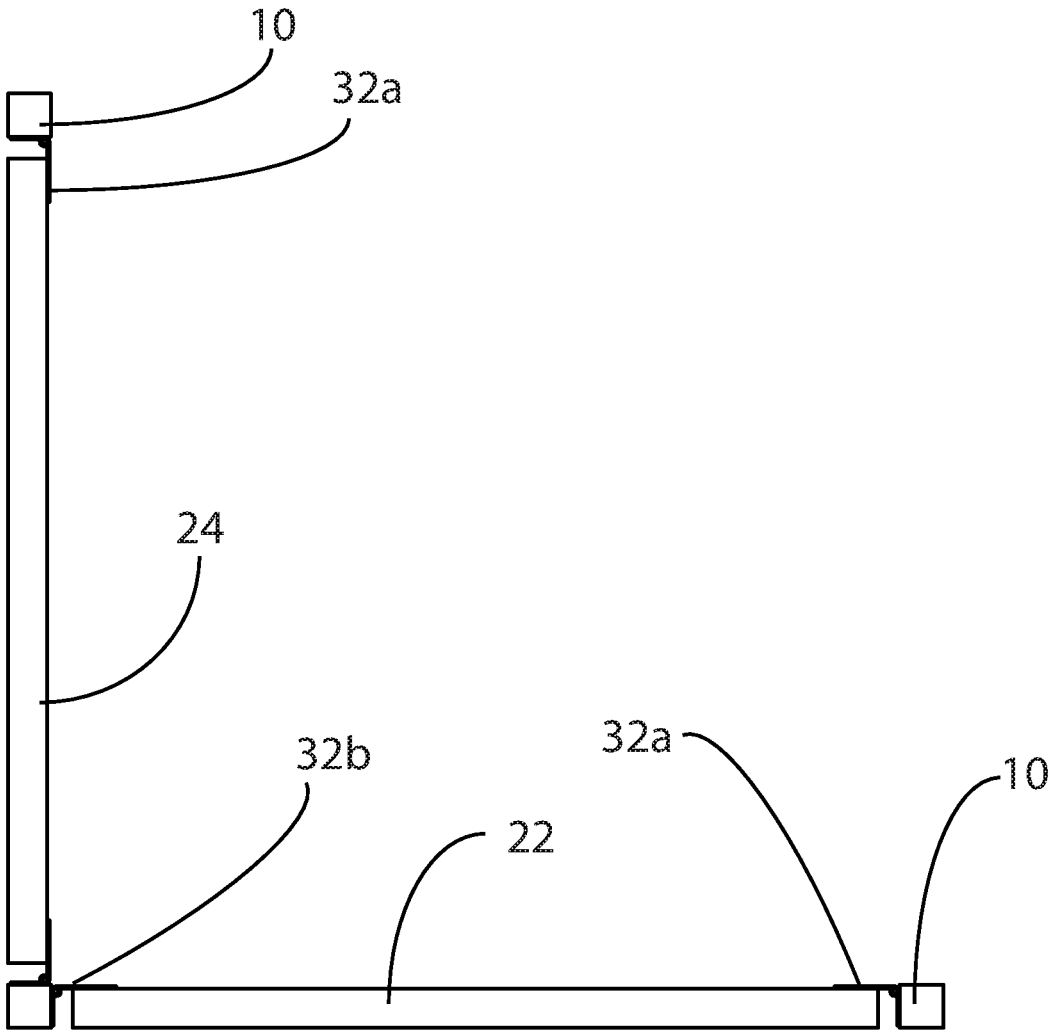
FIG. 4 is a top plan view of an alternate corner construction.

With reference to FIGS. 1-3, the corner 20 has two walls, or panels, a right 22 and a left 24. Each wall is constructed of any known or later discovered material or methodology and may contain supports 26 of any design. Each wall 22, 24 is attached to the structure or adjacent wall of the building 10 by means of hinges, like shear hinge 32 and bearing hinge 34, or some other flexible structure. Likewise, the panels 22, 24 should be attached to each other by some flexible connective structure or hinge 36. These structures need to transmit force across their length between panels and to also allow for rotational moments. It should be noted that many kinds of hinges and other structures may be utilized, and the examples contained herein should be not taken as exhaustive and each one is interchangeable with each other in their use in the constructed corners 20.

Figure 5:
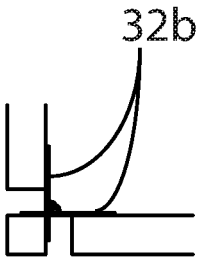
FIG. 5 is an enlarged view of the inner corner of the construction of FIG. 4, showing hinge placement.
Figure 6:
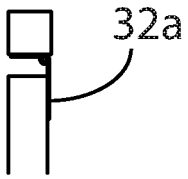
FIG. 6 is an enlarged view of an axial hinge of FIG. 4, showing hinge placement.
Figure 7:
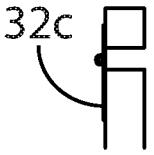
FIG. 7 is an enlarged view of another alternate hinge placement.
Figure 8:
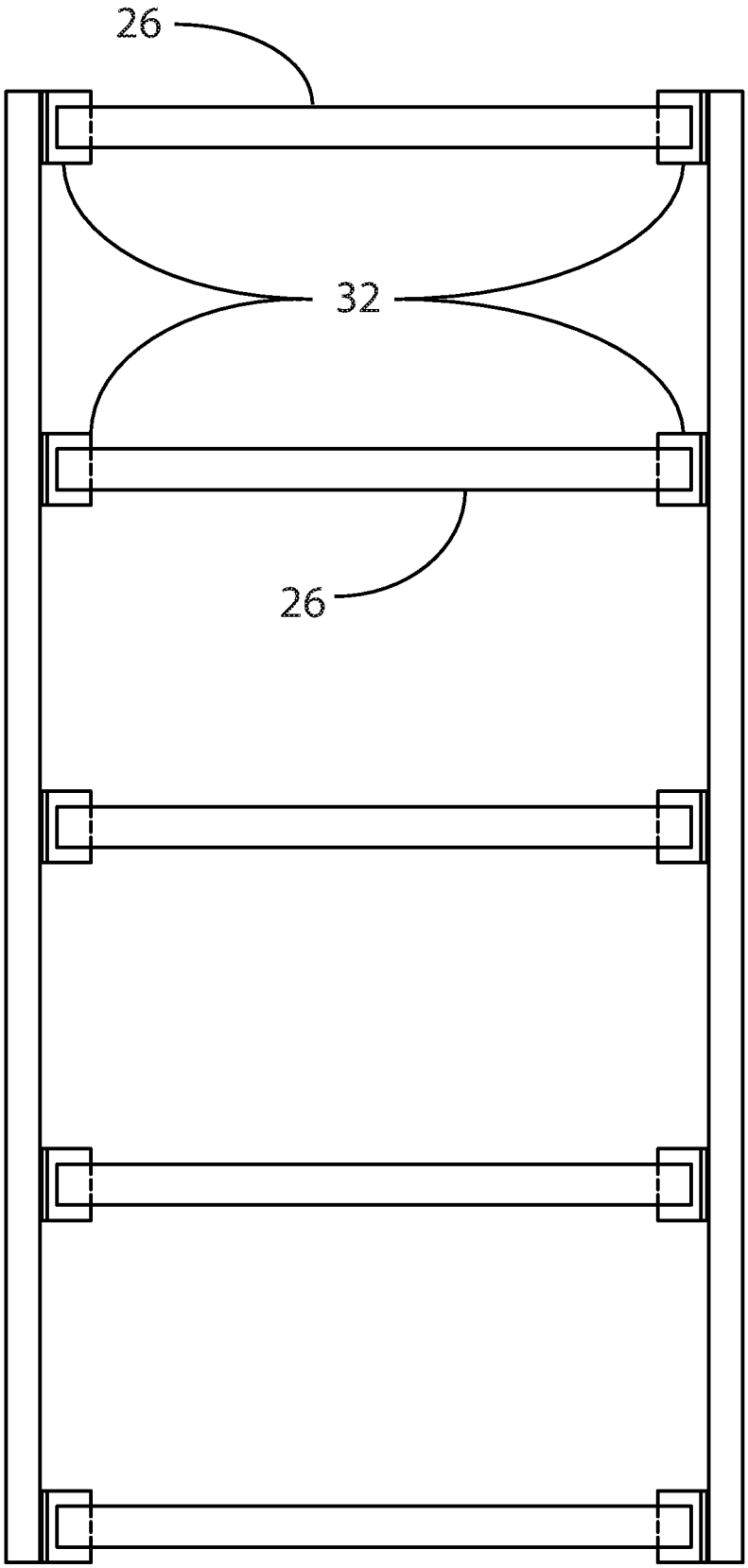
FIG. 8 is a side elevation of one wall in the corner construction of FIG. 4.

At least one connective structure, such as a hinge, will be load bearing, which is to say that the weight of the corner structure will be supported on the load bearing structure(s) or hinge(s). The load bearing structures and the remaining structures will also serve to maintain lateral and vertical stability of the corner 20 with respect to the building 10. The number and placement of these structures will be dependent upon the size, weight and other requirements of a given project. In FIGS. 2 and 3, four axial hinges are utilized-two along the upper edge of the corner and two along the bottom. As seen in FIGS. 4-8, there may be four axial hinges (32*a*) connecting two corner panels to walls 10 and 2 corner hinges (32*b*), one at the corner of the panels 22, 24 between the corner panels. Additional hinges and supports may be added as needed for a given project. Their orientations may also vary. The shear hinges 32*b* illustrated may be oriented one over the other in the corner hinge (FIG. 5). Lateral hinges 32*a* may be placed inside the joint (FIG. 6) or outside 32*c* (FIG. 7) as needed for a given project.

Figure 9:
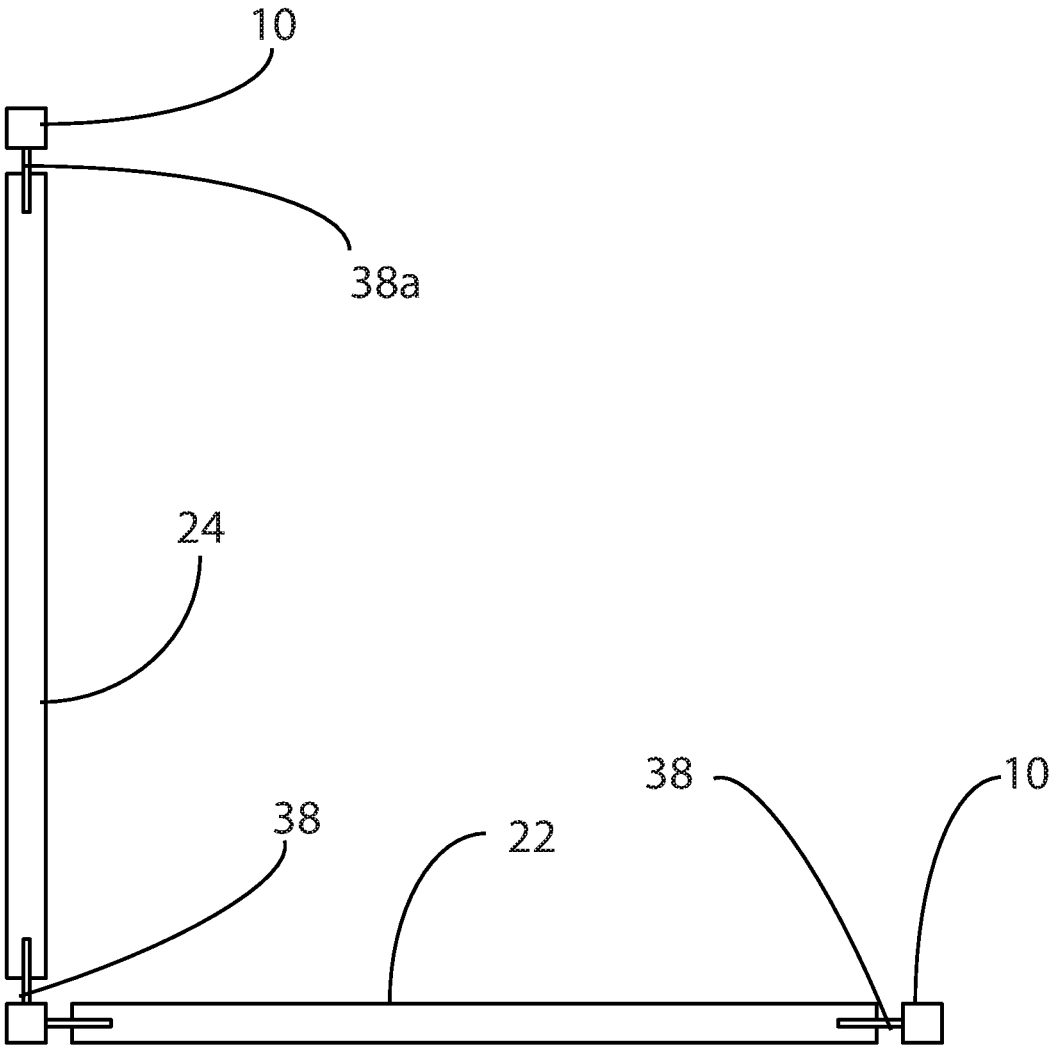
FIG. 9 is a top plan view of an alternate corner construction, utilizing semi-rigid plates.
Figure 10:
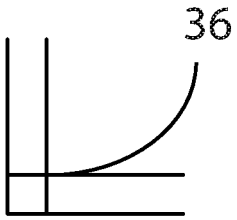
FIG. 10 is a top plan view of an alternate inner corner arrangement.
Figure 11:
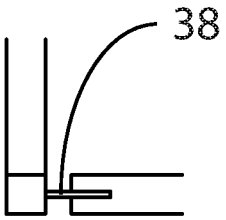
FIG. 11 is a top plan view of another alternate inner corner arrangement.
Figure 12:
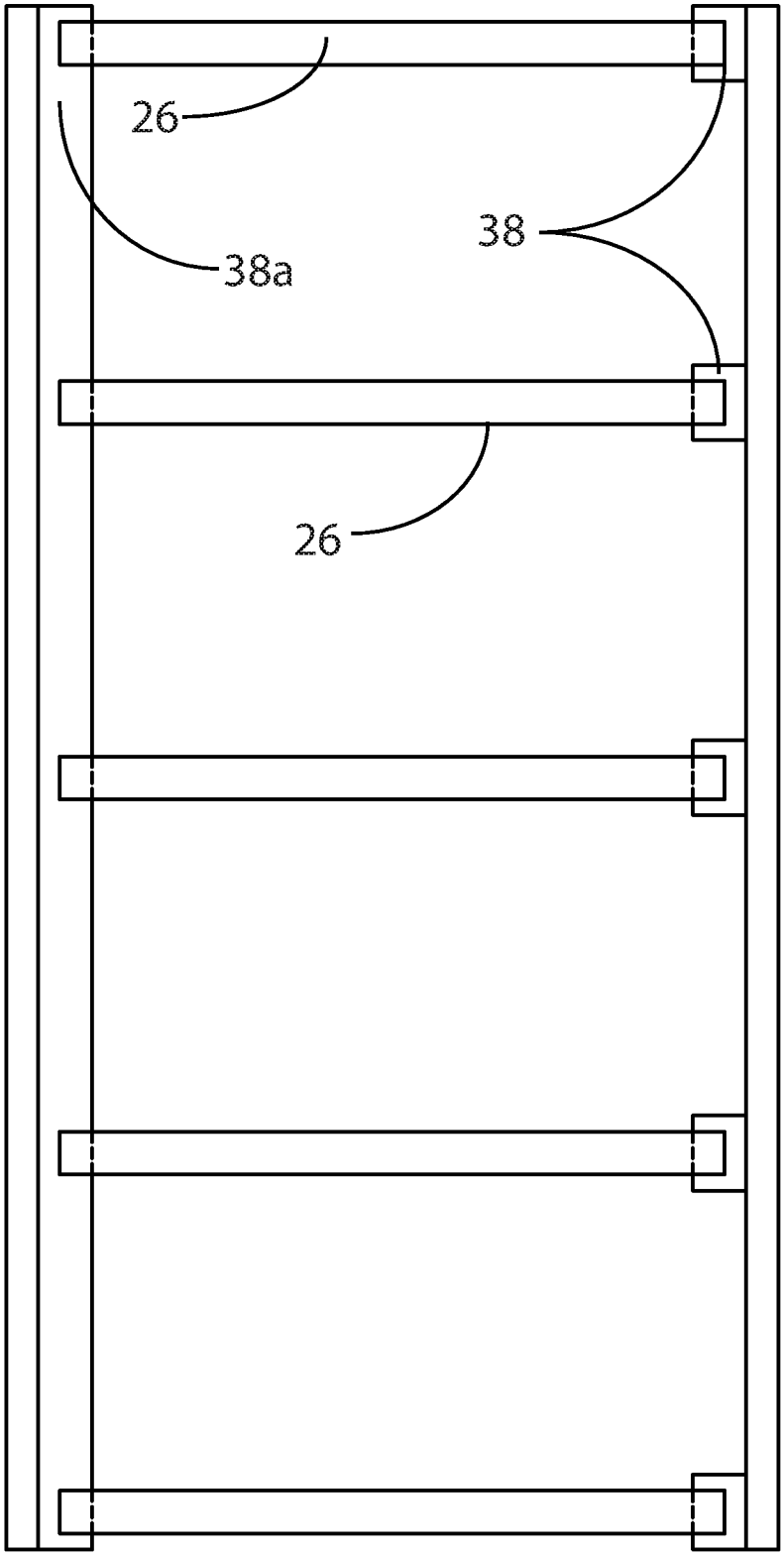
FIG. 12 is a side elevation of the corner construction of FIG. 9.
Figure 16:
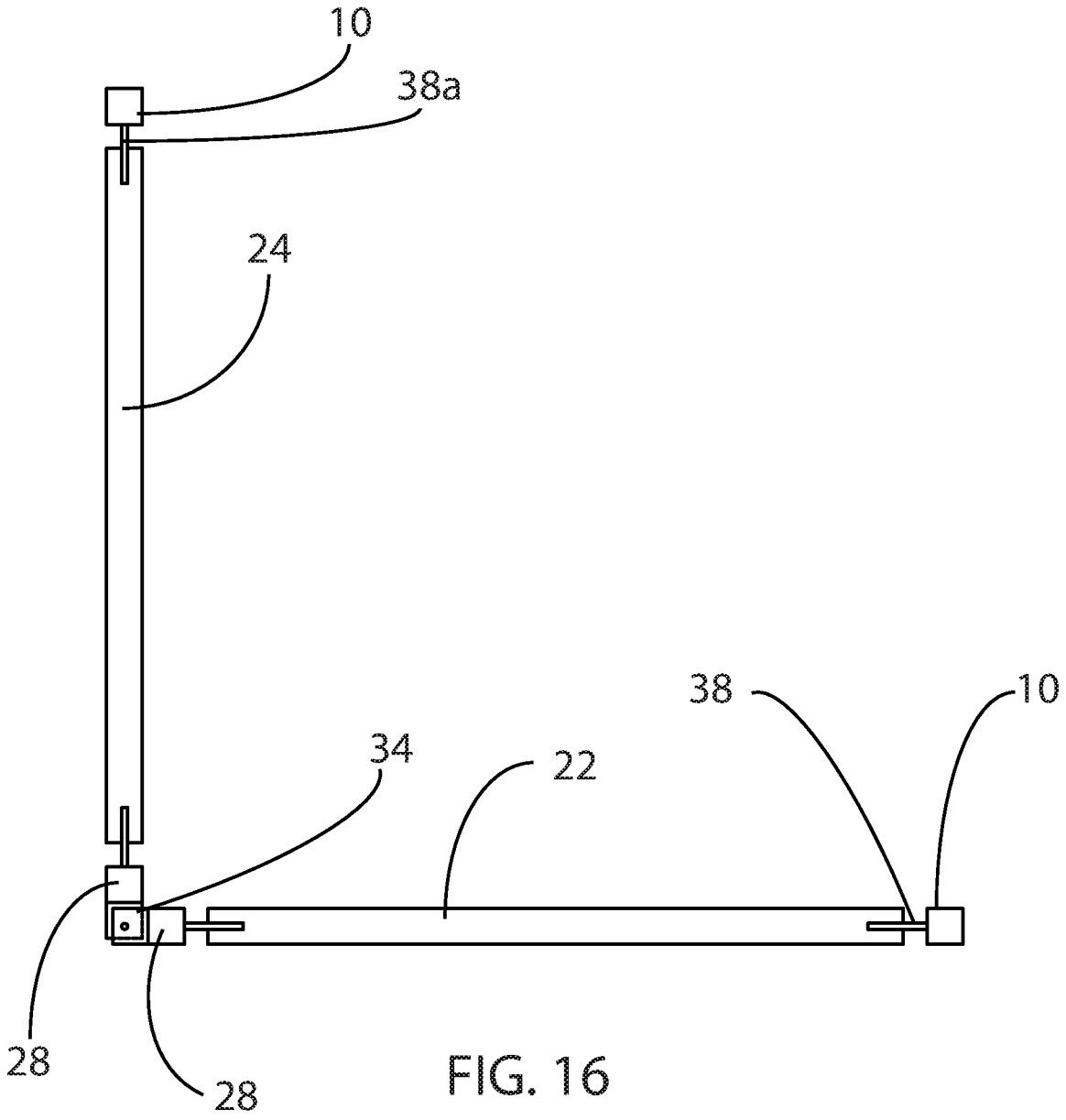
FIG. 16 is a top plan view of an alternate corner construction, also utilizing additional supports.
Figure 17:
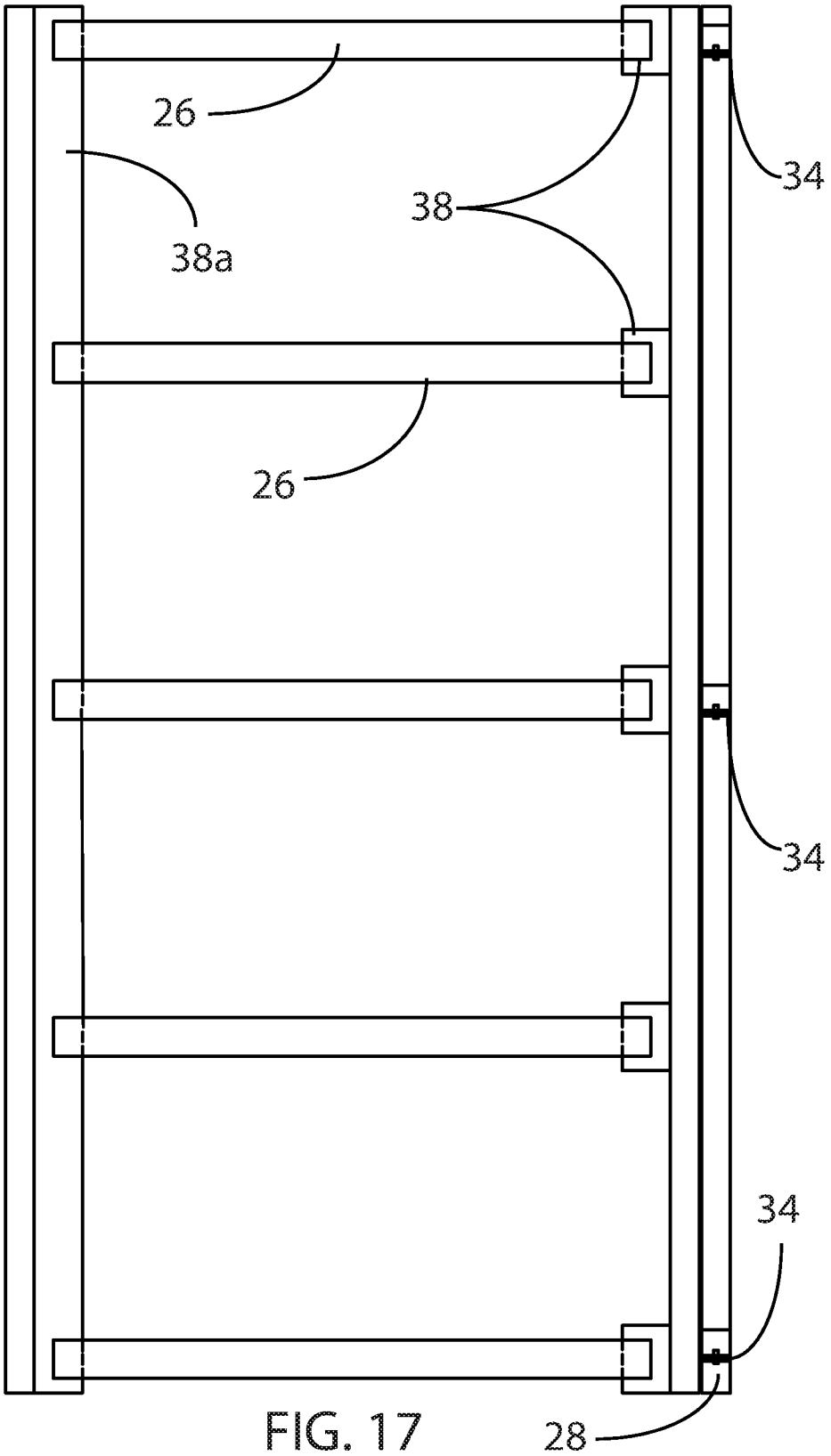
FIG. 17 is a side elevation of the corner construction of FIG. 13.

Semi-rigid materials may also be utilized, as shown in FIGS. 9-12. In FIG. 9, a semi-rigid plate 38 is embedded in each joint at supports 26. Being thinner and semi-rigid, the plates 38 provide a degree of movement necessary for the construction to work. Alternately, for the inner corner, the panels may be deformably used together 36. Likewise, a single plate 38*a* may be embedded in walls and/or panels (FIGS. 16 & 17). These semi-rigid plates may be manufactured of suitable materials such as metals, polymers, fiberglass, and composites.

Figure 13:
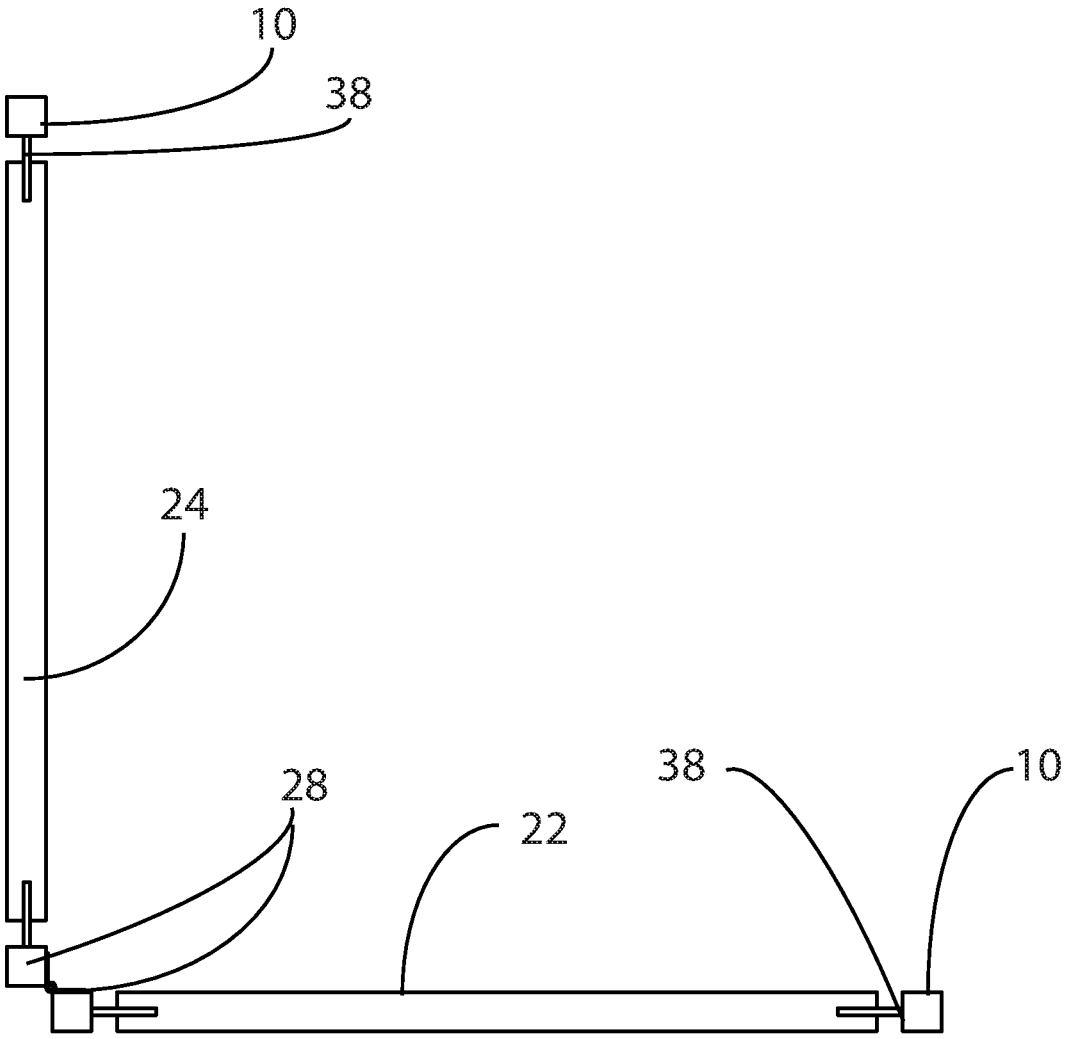
FIG. 13 is a top plan view of an alternate corner construction, utilizing additional supports.
Figure 14:
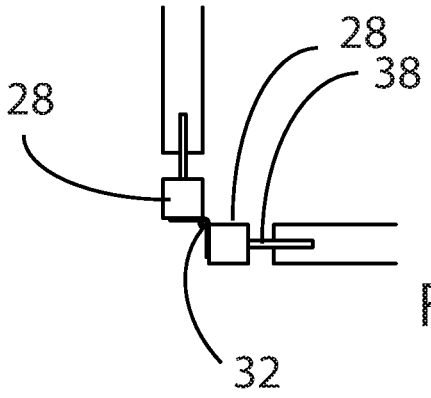
FIG. 14 is a close-up view of the inner corner arrangement in FIG. 13.
Figure 15:
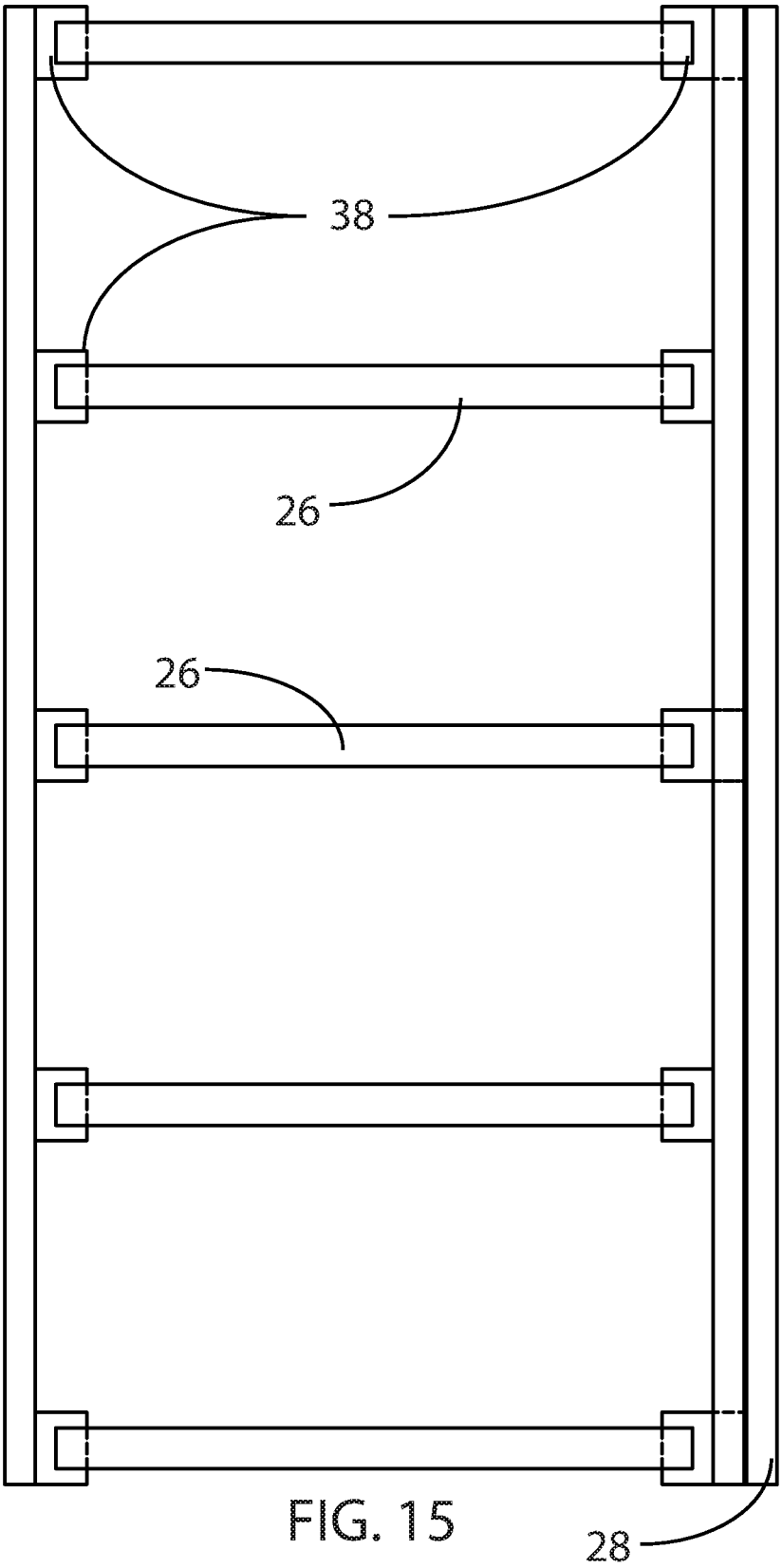
FIG. 15 is a side elevation of the corner construction of FIG. 13.

Additional corner constructions are readily conceivable. These may include a double hinged corner, such as illustrated in FIGS. 13-15. In this embodiment, at least one additional corner support piece 28 is present in the central corner. This piece may be as simple as a bar or rod extending the height of the panel. As illustrated, two such pieces 28 may be hinged together 32 and the support pieces 28 connected to panels 22, 24, such as by the illustrated plates 38. Also, as illustrated in FIGS. 16 and 17, bearing hinges 34 may be used in a double-hinged embodiment with supports 28. The combinations are limited only by known materials and may be assembled in any embodiment so long as the connection to the building walls 10 is flexible but sufficient to bear the weight of the corner 20 and secure it laterally in place.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A corner construction for a building, comprising:

the building comprises at least two support members;

two corner panels each having two vertical edges adjacent to one of the two support members;

at least three connections between each panel and each support member, forming support joints;

at least three connections between the panels forming a corner joint;

at least one of the connections in each support joint being load bearing and supporting the weight of the two panels, transmitting the load to at least one of the support members;

at least one of the connections in the corner joint being a shearing type rotational hinge; and each connection being deformable, enabling rotation of the panels relative to each other and the support members.

2. The corner construction of claim 1, the connections being hinges at each joint.

3. The corner construction of claim 2, the hinges being selected from the set of hinges consisting of: shearing type rotational hinges, bearing type rotational hinges, and ball-in-socket connections.

4. The corner construction of claim 1, further comprising at least one additional corner support and two corner supports hinged together.

5. The corner construction of claim 4, the connections being hinges at each joint.

6. The corner construction of claim 5, the hinges being selected from the set of hinges consisting of: axial hinges and shear hinges.

7. The corner construction of claim 1, the connections of the corner joint being of two separate types and selected from the set of hinges consisting of: shearing type rotational hinges, bearing type rotational hinges, and ball-in-socket connections.

8. The corner construction of claim 1, wherein each connection is embedded within its respective joint.

9. A configuration of a corner construction, comprising:

a first wall and a second wall, wherein both the first wall and the second wall are connected to a building;

a first panel connected to the first wall by a first flexible hinge and a second flexible hinge and the first flexible hinge and the second flexible hinge are embedded in the first panel;

a second panel connected to the second wall by a third flexible hinge and a fourth flexible hinge and the third flexible hinge and the fourth flexible hinge are embedded in the second panel;

the first, second, third, and fourth flexible hinges are selected from the set of hinges consisting of: shearing type rotational hinges, bearing type rotational hinges, and ball-in-socket connections; and the first panel and the second panel are deformably fused together such that the first panel and the second panel form a corner construction, wherein the weight of the corner construction is supported by the first, second, third, and fourth flexible hinges.

10. The configuration of claim 9, wherein the first, second, third, and fourth flexible hinges are constructed from a material selected from the group consisting of: metals, polymers, fiberglass, and composites.

11. The configuration of claim 9, wherein at least one of the first flexible hinge and the second flexible hinge is a gravity connection, and at least one of the third flexible hinge and the fourth flexible hinge is a gravity connection.

12. A corner construction for a building, comprising:

a first wall and a second wall, wherein both the first wall and the second wall are connected to a building;

a first panel connected to the first wall by at least two flexible wall connections;

a second panel connected to the second wall by at least two flexible wall connections;

the first panel connected to a first corner support by at least one rigid panel connection;

the second panel connected to a second corner support by at least one rigid panel connection;

the first corner support connected to the second corner support by at least two flexible corner connections; and the first panel, the second panel, the rigid panel connections, the first corner support, the second corner support, and the flexible corner connections forming a corner construction, wherein the weight of the corner construction is supported by the wall connections.

13. The corner construction of claim 12, wherein the flexible wall connections and the flexible corner connections are selected from the set of hinges consisting of: shearing type rotational hinges, bearing type rotational hinges, and ball-in-socket connections.

14. The corner construction of claim 13, wherein the flexible wall connections and the rigid panel connections and the flexible corner connections are embedded.

15. The corner construction of claim 12, wherein the flexible wall connections between the first panel and the first include a gravity connection, and the flexible wall connections between the second panel and the second wall include a gravity connection.

16. The corner construction of claim 12, wherein the flexible corner connection is selected from the set of hinges consisting of: shearing type rotational hinges, bearing type rotational hinges, and ball-in-socket connections.

* * * * *